US008899281B2

(12) United States Patent
Russell

(10) Patent No.: US 8,899,281 B2
(45) Date of Patent: Dec. 2, 2014

(54) DRINKING VESSEL FILLABLE FROM THE BOTTOM AND APPARATUS FOR DISPENSING A BEVERAGE THEREIN

(76) Inventor: Charles Russell, Dublin (IE)

( * ) Notice: Subject to any disclaimer, the term of this patent is extended or adjusted under 35 U.S.C. 154(b) by 1413 days.

(21) Appl. No.: 12/224,743

(22) PCT Filed: Feb. 28, 2007

(86) PCT No.: PCT/IE2007/000029

§ 371 (c)(1),
(2), (4) Date: Sep. 4, 2008

(87) PCT Pub. No.: WO2007/102139

PCT Pub. Date: Sep. 13, 2007

(65) Prior Publication Data

US 2010/0043911 A1 Feb. 25, 2010

(30) Foreign Application Priority Data

Mar. 6, 2006 (IE) ..... S2006/0165

(51) Int. Cl.

| | |
|---|---|
| ***B67C 3/02*** | (2006.01) |
| ***A47G 19/22*** | (2006.01) |
| ***B67D 1/04*** | (2006.01) |

(52) U.S. Cl.

CPC ..... *B67D 1/04* (2013.01); *A47G 19/2205* (2013.01); *B67D 2210/00068* (2013.01)

USPC ..... 141/113; 215/2

(58) Field of Classification Search

USPC ..... 141/113; 251/2

See application file for complete search history.

(56) References Cited

U.S. PATENT DOCUMENTS

| | | | | | |
|---|---|---|---|---|---|
| 1,563,794 | A | * | 12/1925 | Roberts | 239/28 |
| 2,107,309 | A | | 4/1937 | Smith | |
| 3,094,250 | A | * | 6/1963 | Molyneaux et al. | 222/207 |
| 3,203,454 | A | * | 8/1965 | Micallef | 141/113 |
| 3,246,807 | A | | 4/1966 | Micallef | |
| 3,563,287 | A | * | 2/1971 | Ruddick | 141/59 |
| 3,563,413 | A | | 2/1971 | Gordon | |
| 3,592,244 | A | * | 7/1971 | Chamberlin | 141/14 |
| 3,705,668 | A | | 12/1972 | Schwatzman | |
| 3,718,165 | A | * | 2/1973 | Grothoff | 141/20 |
| 4,142,651 | A | * | 3/1979 | Leopoldi et al. | 222/185.1 |
| 4,473,097 | A | * | 9/1984 | Knickerbocker et al. | 141/113 |
| 4,481,986 | A | * | 11/1984 | Meyers | 141/4 |
| 4,877,065 | A | * | 10/1989 | Lamboy et al. | 141/18 |

(Continued)

FOREIGN PATENT DOCUMENTS

| | | |
|---|---|---|
| DE | 38 14937 | 6/1989 |
| ES | 2 326 609 | 10/2009 |

(Continued)

*Primary Examiner* — Timothy L Maust
(74) *Attorney, Agent, or Firm* — Tod R. Nissle, P.C.

(57) ABSTRACT

The present invention relates to a drinking vessel (1), comprising a base (2) and at least one wall (3), wherein the base and the wall together define a chamber (4) for receiving a beverage. The drinking vessel further comprises a sealable aperture (5) provided adjacent the base for filling the chamber with a beverage. In a preferred embodiment, the aperture is provided in the base of the vessel. In one embodiment, a non-return valve is disposed in said aperture. The valve allows a beverage to be dispensed into the vessel through the aperture but prevents the beverage from escaping from the vessel through the aperture. The invention also relates to a method and apparatus for dispensing a beverage.

4 Claims, 4 Drawing Sheets

(56) References Cited

U.S. PATENT DOCUMENTS

| | | | | |
|---|---|---|---|---|
| 5,260,081 | A * | 11/1993 | Stumphauzer et al. | 426/477 |
| 5,312,019 | A * | 5/1994 | Tsao | 222/105 |
| 5,409,124 | A * | 4/1995 | Nasrallah et al. | 215/388 |
| 5,913,454 | A | 6/1999 | McHale | |
| 6,209,737 | B1 | 4/2001 | Bliss | |
| 7,377,296 | B2 * | 5/2008 | Gueret | 141/352 |
| 7,455,082 | B2 * | 11/2008 | Monzel | 141/18 |
| 7,845,375 | B2 * | 12/2010 | Dorney | 141/94 |
| 2005/0269336 | A1 | 12/2005 | Rockhill et al. | |
| 2006/0138167 | A1 * | 6/2006 | McMahon et al. | 222/100 |
| 2008/0223478 | A1 * | 9/2008 | Hantsoo et al. | 141/2 |

FOREIGN PATENT DOCUMENTS

| | | |
|---|---|---|
| FR | 2 657 846 | 8/1991 |
| GB | 2 136 882 A | 9/1984 |
| GB | 2 137 181 A | 10/1984 |
| GB | 2 368 335 B | 6/2004 |
| WO | WO 2005/058745 | 6/2005 |
| WO | WO 2006/055870 | 5/2006 |

* cited by examiner

DRINKING VESSEL FILLABLE FROM THE BOTTOM AND APPARATUS FOR DISPENSING A BEVERAGE THEREIN

FIELD OF THE INVENTION

The present invention relates to drinking vessels and, in particular, to glasses for beer.

BACKGROUND OF THE INVENTION

Conventionally, beverages are dispensed into drinking vessels simply by pouring the beverage into the mouth of the vessel. Draught beer, for example, is generally dispensed from a beer tap directly into the mouth of a beer glass.

Most beers are carbonated with carbon dioxide. The carbon dioxide dissolved in the beer is what makes the beer fizzy. When beer is poured into a glass from a beer tap, the agitation of pouring and the turbulence created by the stream of beer hitting the bottom of the glass as it falls from the tap causes some of the carbon dioxide to bubble out of solution, forming a head of foam on the glass of beer. However, if the beer is dispensed by someone who is not particularly skilled in the art of beer pouring, an excessive head of foam may be formed on the upper surface of the beer. This may also occur when pouring carbonated soft drinks.

Other beers, such as stouts, are less fizzy than carbonated lager beers, as they contain less dissolved carbon dioxide. However, these beers, once poured, require "settling time" to allow the turbulence created in the beer during pouring to subside and to allow a creamy head to form on the beer. The time involved in correctly pouring a glass of stout can be up to three minutes, including settling time.

It is therefore desirable to allow beverages such as beer to be dispensed in a such a way that the turbulence and agitation created in the beverage during dispensing is reduced, thereby making correct dispensing of the beverage easier and reducing settling time required. A number of techniques have been proposed.

British Patent No. GB2353785 describes a nozzle for a beer dispenser, which is inserted into a beer glass to dispense beer near the bottom of the glass. The nozzle is operated by pressing the bottom of the glass upwards against a spring bias to open apertures in the nozzle.

British Patent No. GB2178003 relates to a method of dispensing beer at the bottom of a glass and describes a dispensing nozzle is adapted to reach the bottom of the glass.

British Patent No. GB2322691 relates to a beverage dispenser with a long outlet spout, which in use extends to the bottom of a glass into which the beverage is to be dispensed. Beverage is dispensed when the end of the spout is pressed against the bottom of the glass.

One problem associated with these arrangements is that a nozzle must be inserted into the glass so that it extends to the bottom thereof. The nozzle is thus immersed in the beer in the glass. When the next glass of beer is dispensed, the nozzle, along with its coating of stale beer, is inserted into the new glass, which could be unhygienic.

OBJECT OF THE INVENTION

An object of the invention is to provide an alternative method for filling a drinking vessel at the bottom, and a drinking vessel suitable for use therein. Another object of the invention is to provide an arrangement which overcomes the problems associated with the prior art.

SUMMARY OF THE INVENTION

According to the present invention, there is provided a drinking vessel comprising a base and at least one wall extending therefrom, wherein the base and the wall together define a chamber for receiving a beverage; characterised in that the vessel further comprises a sealable aperture provided adjacent the base for filling the chamber with a beverage.

Preferably, the sealable aperture is provided in the base of the vessel. Alternatively, the aperture may be provided in the wall of the vessel close to the base.

An advantage of this arrangement is that the vessel can be filled through the aperture in the base, rather than by pouring the beverage through the mouth of the vessel in the conventional manner. Filling the vessel at the bottom in this way reduces the turbulence induced in the beverage as it is dispensed into the vessel. This is particularly advantageous when dispensing carbonated beverages such as beer and "fizzy" soft drinks, as it prevents an excessive head of foam from being produced at the top of the beverage. The beverage can thus be dispensed more quickly than is possible with conventional arrangements. It also reduces the risk over overflowing the vessel due to a large amount of foam being formed in the beverage as it is poured. When used for beers which require settling time, such as stouts, the drinking vessel of the present invention reduces the settling time required. For a pint of stout dispensed into an appropriately sized drinking vessel according to the present invention, the total time taken to prepare the beverage is reduced to approximately one minute, including settling time. The beverage is consumed by a user through the mouth of the vessel in the usual manner.

In a preferred embodiment of the invention, the drinking vessel further comprises a non-return or directional valve disposed in said aperture, wherein the valve allows a beverage to be dispensed into the vessel through the aperture but prevents the beverage from escaping from the vessel through the aperture.

Preferably, the non-return valve is of the type comprising a silicone membrane.

The strength of the valve may be selected to ensure that it can withstand the pressure exerted on it by liquid in the vessel when the vessel is full. For example, where the vessel is a pint glass, the valve is ideally capable of withstanding at least the pressure exerted on it by one pint (0.568 liters) of liquid. Preferably, the valve is capable of withstanding pressure in excess of that exerted by liquid in the vessel when the vessel is full.

One advantage of this arrangement is that that the aperture is automatically or self sealed once the beverage has been dispensed through the aperture and the non-return valve. The valve allows flow of liquid in one direction only, that is, into the vessel, thereby preventing leakage from the vessel while the beverage is being consumed.

A further advantage of the arrangement is improved hygiene over previously suggested arrangements which require a long spout or nozzle to be inserted into the vessel, through beverage already dispensed. Where a nozzle is used to dispense beverage into the vessel, the membrane has the effect of wiping the nozzle as it inserted into the base of the vessel. The present invention also allows the beverage to be dispensed into the vessel without requiring a nozzle to be inserted therein. An upwardly directed, pressurized stream of beverage, in the manner of a drinking fountain, may be provided. The pressure of the stream alone is sufficient to open the valve and allow beverage to be dispensed into the vessel, without any spout or nozzle entering the vessel.

In one embodiment, the drinking vessel is a beer glass. The vessel may be made from a plastic material.

Preferably, the at least one wall of the vessel is substantially rigid. The base of the vessel may also be rigid. This prevents liquid being expelled from the vessel through the valve by squeezing the walls of the vessel. This allows the user to grip the vessel as he would a regular glass without fear of accidentally forcing liquid out of the vessel through the valve in the base.

According to a second aspect of the invention, there is provided apparatus for dispensing a beverage, comprising an inlet portion connectable to a pressurised beverage supply; at least one outlet portion arranged to dispense the beverage; and conduit means provided between said inlet portion and said outlet portion to provide a fluid path for said beverage therebetween; characterised in that the apparatus is operable to allow the beverage to pass from the inlet portion to the outlet portion under pressure through said conduit means such that the beverage is dispensed at said outlet portion in a substantially upward direction.

The apparatus described above may be used with the drinking vessel of the present invention. The drinking vessel is placed over an outlet portion such that the beverage is dispensed into the vessel through the sealable aperture in the base thereof.

In one embodiment, the apparatus comprises a plurality of outlet portions to allow several drinking vessels to be filled simultaneously.

In one embodiment, the or each outlet portion is engageable with an aperture provided in the base of a drinking vessel. The apparatus may include a nozzle associated with the or each outlet portion for insertion into the drinking vessel through a sealable aperture in the base to dispense beverage into the vessel. Each nozzle may be provided with at least one dispensing aperture. Preferably, each nozzle is provided with a plurality of dispensing apertures arranged around the circumference thereof, such that the beverage is dispensed in a substantially upward and outward direction from the nozzle.

Alternatively, an upwardly directed, pressurized stream of beverage may be dispensed at the or each outlet portion, similar to a drinking fountain. Where the drinking vessel is provided with a non-return valve disposed in the aperture, the pressure of the stream of beverage is sufficient to open the valve and allow beverage to be dispensed into the vessel.

The apparatus may be operable to allow the beverage to be dispensed at a relatively slow rate initially when the vessel into which the beverage is to be dispensed is empty. The apparatus may also be operable to allow the dispense rate to be increased once the beverage has reached a predetermined level in the vessel.

The apparatus may further comprise automatic activation means to allow a beverage to be dispensed automatically. The automatic activation means may comprise a card reader arranged to read a swipe card and to dispense a beverage in accordance with information contained on the swipe card. Alternatively, the automatic activation means may comprise a receiver arranged to receive a signal from a remote control device and to dispense a beverage in accordance with the received signal.

The present invention also relates to a method for dispensing a beverage, comprising the steps of providing a drinking vessel having a sealable aperture in a base thereof and dispensing a beverage into the vessel through the sealable aperture in the base.

In one embodiment, the method further comprises the step of sealing the aperture in the base of the vessel. However, in the preferred embodiment, the drinking vessel comprises a non-return valve disposed in the aperture as described above, and the aperture is, therefore, automatically sealed by the valve after the beverage has been dispensed.

The method may further comprise the steps of positioning the drinking vessel at an outlet portion of the apparatus described above, and operating the apparatus to dispense the beverage into the vessel in a substantially upward direction. The step of positioning the drinking vessel may include engaging the aperture in the base of the drinking vessel with the outlet portion of the apparatus, for example, by inserting the nozzle into the aperture.

DETAILED DESCRIPTION OF THE DRAWINGS

Figure 1:
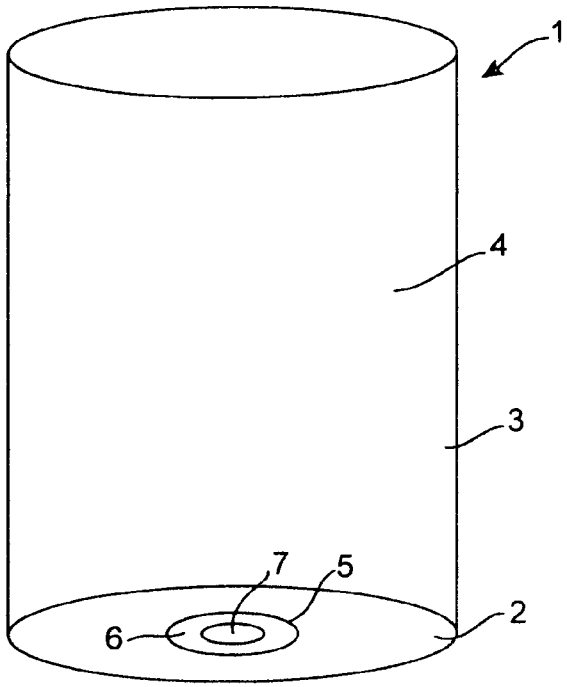
FIG. 1 is a perspective view of a drinking vessel according to an embodiment of the present invention.
Figure 2:
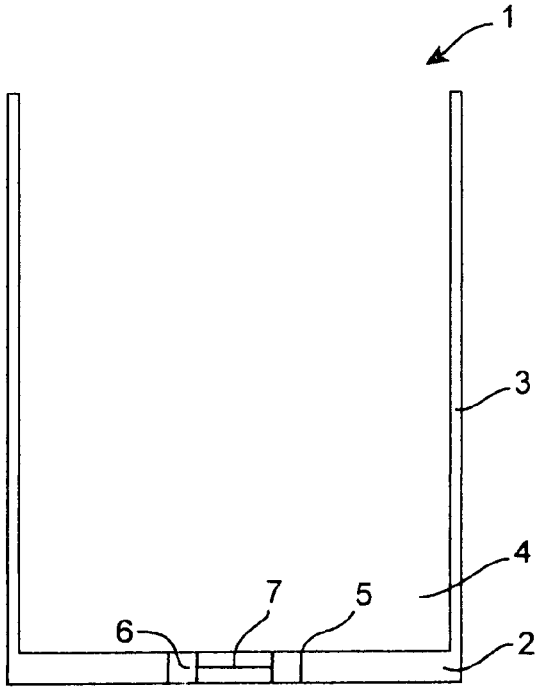
FIG. 2 is an elevation view of the drinking vessel of FIG. 1.
Figure 3:
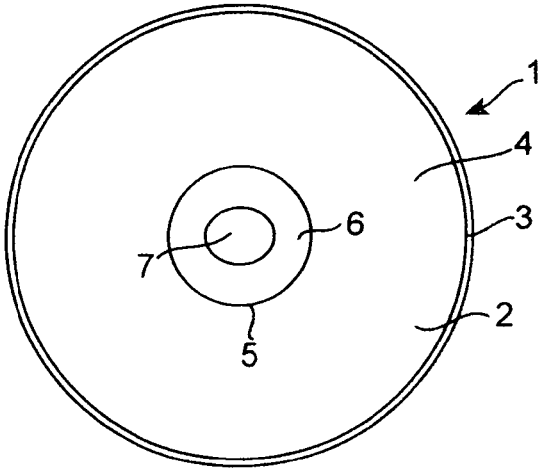
FIG. 3 is a top plan view of the drinking vessel of FIG. 1.

Referring to FIGS. 1 to 3 of the drawings, there is illustrated a drinking vessel 1 comprising a base 2 and a substantially cylindrical wall 3. The base 2 and the wall 3 together define a chamber 4 for receiving a beverage. The vessel 1 also comprises a sealable aperture 5 provided in the base 2 for filling the chamber 4 with a beverage.

The vessel 1 further comprises a non-return valve 6 disposed in the aperture 5. The valve 6 allows a beverage to be dispensed into the chamber through the aperture 5 but prevents the beverage from escaping from the vessel through the aperture. In the embodiment shown, the non-return valve is of the type comprising a silicone membrane 7 with a slit provided therein.

In use, a beverage is dispensed into the vessel through the sealable aperture 5 in the base 2. The aperture is automatically sealed by the valve 6 after the beverage has been dispensed into the vessel.

Figure 4:
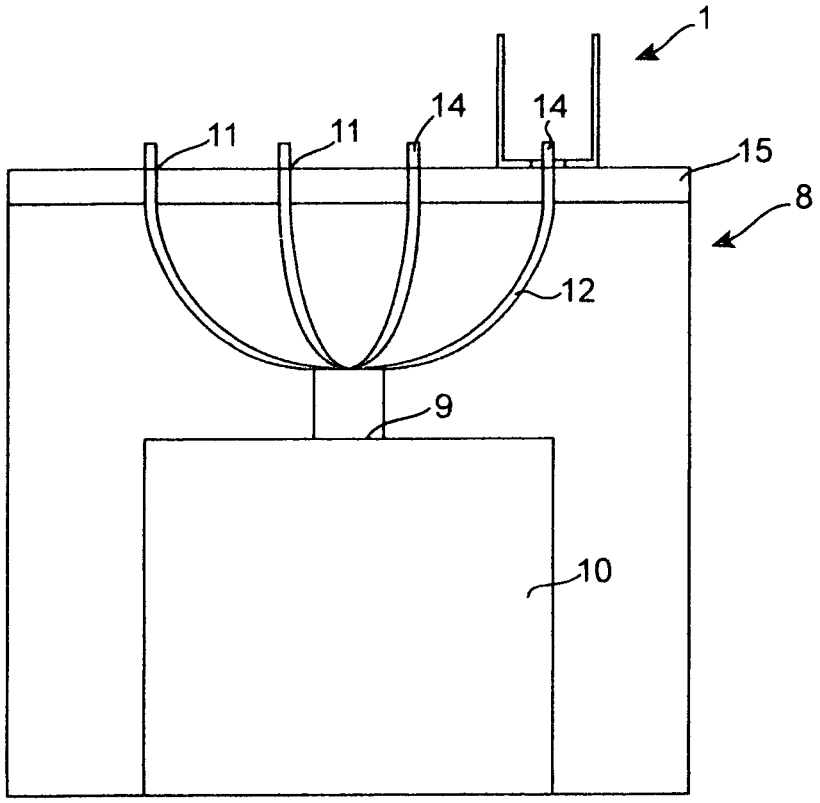
FIG. 4 is an elevation view of an apparatus according to an embodiment of the present invention.
Figure 5:
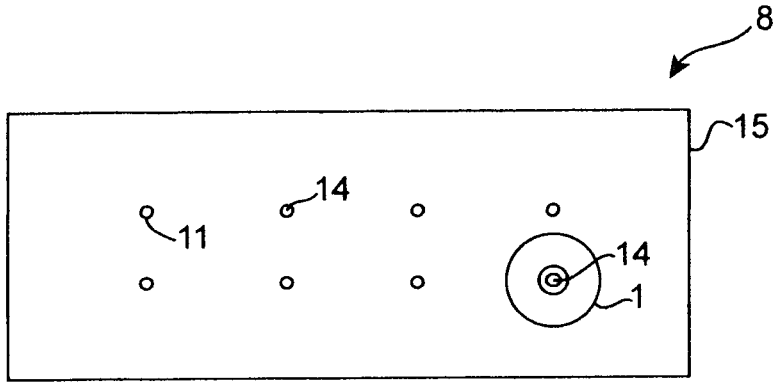
FIG. 5 is a top plan view of the apparatus of FIG. 4.

Referring now to FIGS. 4 and 5, an apparatus 8 for dispensing a beverage comprises an inlet portion 9 connectable to a pressurised beverage supply 10. The apparatus 8 also comprises a plurality of outlet portions 11 arranged to dispense the beverage at an upper surface 15 of the apparatus. The apparatus may be incorporated into a bar counter such that the upper surface 15 of the apparatus is substantially flush with the bar surface.

In the embodiment shown, each outlet portion 11 comprises a nozzle 14, which is engageable with an aperture provided in the base of a drinking vessel. Conduit means 12 are provided between the inlet portion 9 and the outlet portions 11 to provide a fluid path for the beverage therebetween. The apparatus is operable to allow the beverage to pass from the inlet portion 9 to the outlet portions 11 under pressure through the conduit means 12, thereby allowing a stream of beverage to be dispensed from each nozzle 14 in a substantially upward direction. The nozzles may be operated individually or simultaneously.

In use, a drinking vessel 1 as described above with referenced to FIGS. 1 to 3 is positioned at an outlet portion 11 of the apparatus 1 such that one of the nozzles 14 is inserted into the vessel through the sealable aperture 5 in the base thereof. The apparatus is then operated to dispense beverage into the vessel in a substantially upward direction.

In an alternative embodiment, no nozzles are provided and the pump means is operable to allow an upwardly directed, pressurized stream of beverage to be dispensed at each outlet portion 11, similar to a drinking fountain. The pressure of the stream of beverage is sufficient to open the valve 6 in the base of the drinking vessel and allow beverage to be dispensed into the vessel, without a nozzle being inserted into the vessel.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Figure 6:
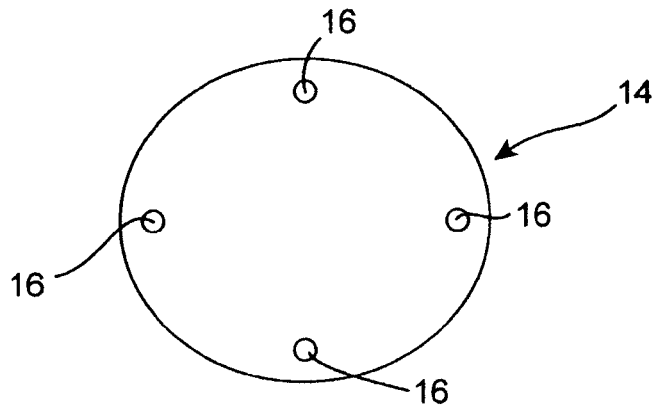
FIG. 6 is a plan view of a nozzle with an arrangement of dispensing apertures according to an embodiment of the present invention; and, FIG. 7 is a block diagrammatic of an apparatus according to an embodiment of the present invention.

Referring now to FIG. 6, there is shown an arrangement of dispensing apertures 16 formed around the circumference of the nozzle 14.

Figure 7:
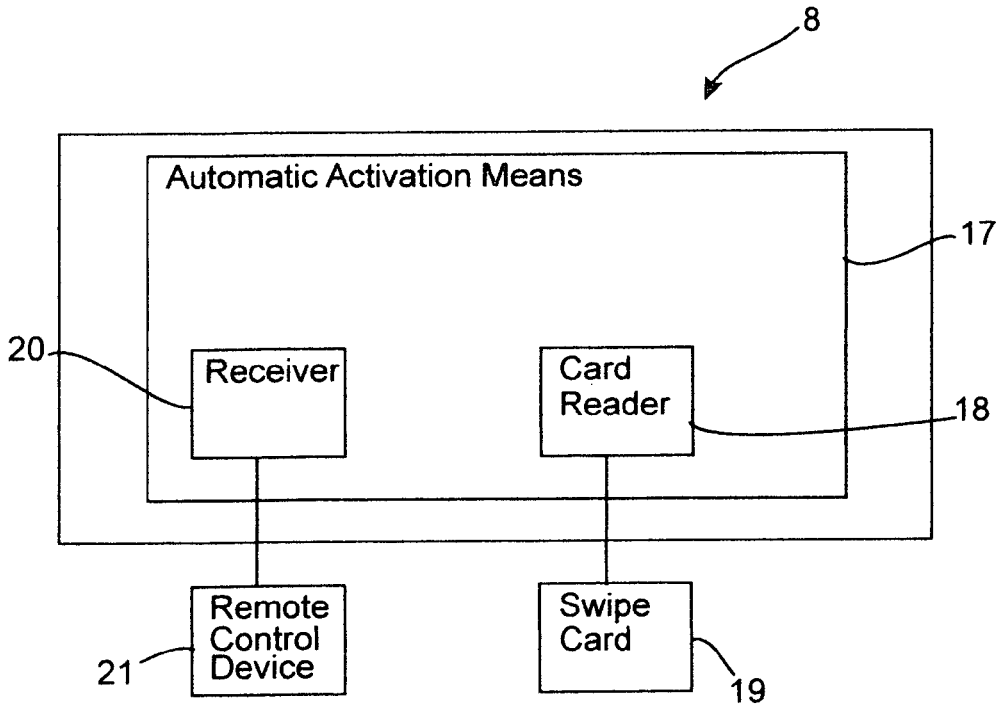

Referring now to FIG. 7, there is shown an embodiment of the apparatus 8 which includes automatic activation means 17 to allow the carbonated beverage to be dispensed automatically. The automatic activation means 17 comprises a card reader 18 arranged to read a swipe card 19 and to dispense said carbonated beverage in accordance with information contained on the swipe card 19. The automatic activation means 17 comprises a receiver 20 arranged to receive a signal from a remote control device 21 and to dispense said carbonated beverage in accordance with the received signal.

The invention claimed is:

1. Apparatus for dispensing a carbonated beverage in combination with a drinking vessel for the beverage to prevent excessive head of foam, the drinking vessel comprising a base and at least one wall extending therefrom which together define a chamber for receiving the beverage, and a sealable aperture in or adjacent the base, the apparatus comprising:

an inlet portion connectable to a pressurized carbonated beverage supply;

at least one outlet portion arranged to dispense the beverage; and a conduit provided between said inlet portion and said outlet portion to provide a fluid path for said beverage therebetween;

wherein the or each outlet portion is engageable with the sealable aperture provided in or adjacent the base of the drinking vessel to dispense the beverage into the vessel through the sealable aperture and the apparatus is operable to allow the beverage to pass from the inlet portion to the outlet portion under pressure through said conduit such that the beverage is dispensed at said outlet portion into the vessel through the sealable aperture in or adjacent the base;

wherein the or each outlet portion of the dispensing apparatus comprises a nozzle, and wherein the nozzle is provided with a plurality of dispensing apertures arranged around the perimeter thereof, such that the beverage is dispensed in a substantially outward direction from the nozzle.

2. A method for dispensing a carbonated beverage to prevent excessive head of foam, comprising the steps of:

providing a drinking vessel having a sealable aperture in or adjacent a base thereof;

engaging the aperture in or adjacent the base of the drinking vessel with an outlet portion of an apparatus for dispensing said carbonated beverage, the apparatus comprising:

an inlet portion connectable to a pressurized carbonated beverage supply;

at least one outlet portion arranged to dispense the beverage; and a conduit provided between said inlet portion and said outlet portion to provide a fluid path for said beverage therebetween; and operating the apparatus to allow the beverage to pass from the inlet portion to the outlet portion under pressure through said conduit to dispense the beverage into the vessel through the sealable aperture in or adjacent the base;

the or each outlet portion of the dispensing apparatus comprises a nozzle, and the nozzle is provided with a plurality of dispensing apertures arranged around the perimeter thereof, such that the beverage is dispensed in a substantially outward direction from the nozzle, and whereby engaging the aperture with the outlet portion of the apparatus comprises inserting the nozzle into the aperture.

3. Apparatus for dispensing a carbonated beverage in combination with a drinking vessel for the beverage to prevent excessive head of foam, the drinking vessel comprising a base and at least one wall extending therefrom which together define a chamber for receiving the beverage, and a sealable aperture in or adjacent the base, the apparatus comprising:

an inlet portion connectable to a pressurized carbonated beverage supply;

at least one outlet portion arranged to dispense the beverage; and a conduit provided between said inlet portion and said outlet portion to provide a fluid path for said beverage therebetween;

wherein the or each outlet portion is engageable with the sealable aperture provided in or adjacent the base of the drinking vessel to dispense the beverage into the vessel through the sealable aperture and the apparatus is operable to allow the beverage to pass from the inlet portion to the outlet portion under pressure through said conduit such that the beverage is dispensed at said outlet portion into the vessel through the sealable aperture in or adjacent the base, in which the apparatus includes automatic activation means to allow said carbonated beverage to be dispensed automatically, and in which the automatic activation means comprises a card reader arranged to read a swipe card and to dispense said carbonated beverage in accordance with information contained on the swipe card.

4. Apparatus for dispensing a carbonated beverage in combination with a drinking vessel for the beverage to prevent excessive head of foam, the drinking vessel comprising a base and at least one wall extending therefrom which together define a chamber for receiving the beverage, and a sealable aperture in or adjacent the base, the apparatus comprising:

an inlet portion connectable to a pressurized carbonated beverage supply;

at least one outlet portion arranged to dispense the beverage; and a conduit provided between said inlet portion and said outlet portion to provide a fluid path for said beverage therebetween;

wherein the or each outlet portion is engageable with the sealable aperture provided in or adjacent the base of the drinking vessel to dispense the beverage into the vessel through the sealable aperture and the apparatus is operable to allow the beverage to pass from the inlet portion to the outlet portion under pressure through said conduit such that the beverage is dispensed at said outlet portion into the vessel through the sealable aperture in or adjacent the base, in which the apparatus includes automatic activation means to allow said carbonated beverage to be dispensed automatically, and in which the automatic activation means comprises a receiver arranged to receive a signal from a remote control device and to dispense said carbonated beverage in accordance with the received signal.

* * * * *